United States Patent [19]

Ammon

[11] 3,967,784

[45] July 6, 1976

[54] BEAD DISPENSING GUN FOR MARKING PAVEMENT

[75] Inventor: Harry C. Ammon, Paul, Idaho

[73] Assignee: Idaho Norland Corporation, Paul, Idaho

[22] Filed: May 16, 1975

[21] Appl. No.: 578,292

[52] U.S. Cl. ..... 239/583; 239/595

[51] Int. Cl.[2] ..... B05B 1/04

[58] Field of Search ..... 239/151, 150, 143, 337, 239/583, 595, 599, 601, 336, 411, 410, 592, 594; 222/575

[56] References Cited

UNITED STATES PATENTS

| | | | |
|---|---|---|---|
| 1,979,649 | 11/1934 | Stephenson | 239/595 X |
| 2,821,890 | 2/1958 | Wilson | 239/336 X |
| 3,201,048 | 8/1965 | Gibbs | 239/411 X |
| 3,355,112 | 11/1967 | Shaffer et al. | 239/583 X |
| 3,598,322 | 8/1971 | Rupert | 239/410 |

*Primary Examiner*—John J. Love
*Attorney, Agent, or Firm*—Lynn G. Foster

[57] ABSTRACT

A unique bead dispensing gun for marking pavement, the gun being actuated between open and closed positions, using fluid pressure, and the beads being delivered to and through the gun, when open, also under fluid pressure, with the gun comprising a casing or body forming in part a cylinder in which a piston operates, the lower end of the piston comprising a shut off valve to selectively prevent or permit bead discharge from a bead chamber within the gun, to which beads are supplied by a relatively large external reservoir, through a discharge opening along a novel control chute to the atmosphere, the cylinder/piston arrangement being one way (to open the gun), a return spring returning the gun to the closed position, when the fluid pressure upon the piston is removed.

3 Claims, 5 Drawing Figures

BEAD DISPENSING GUN FOR MARKING PAVEMENT

BACKGROUND

1. Field of Invention

The present invention relates generally to the dispensing of reflective beads and more particularly to a novel bead dispensing gun for marking pavement.

2. Prior Art

Prior art pavement marking bead dispensing guns designed to be carried upon a moving vehicle, such as those illustrated and described in my prior U.S. Pat. No. 3,820,718, have been relatively inefficient causing waste in essentially four fashions, i.e. (*a*) in failing to stop and start the dispensing mode coincident in time with the beginning and end of marking stripes on pavement, (*b*) in failing to distribute beads upon discharge to the exact width dimensions of the stripe being applied to the pavement, (*c*) in failing to suitably control the rate of bead discharge therefrom, and (*d*) in failing to suspend beads in suitable liquid to insure beads will adhere to the quick dry paint used for marking roadways. Typically, state pavement specifications for prior art bead dispensing call for seven pounds per gallon of paint applied to mark highways.

BRIEF SUMMARY AND OBJECTS OF THE PRESENT INVENTION

The present invention provides a novel bead dispensing gun for marking pavement coincident in time when the marking stripes are being painted thereon whereby a substantial reduction in bead utilization is achieved, the preferred bead dispensing gun embodiment comprising a cylinder/piston arrangement operated at least partially by fluid pressure resulting in precise timing in the opening and closing of the gun coincident with the application of paint, the gun further including structure for controlling with precision the rate of discharge of the beads from the gun and further including a discharge chute configurated to precisely define the width of bead discharge upon the pavement so as to be exactly equal to the width of the stripe being painted.

With the foregoing in mind, it is a primary object of the present invention to provide a novel bead dispensing gun which results in substantial savings in the quantity of the beads utilized in marking a given amount of pavement.

It is a further significant object of the present invention to provide a novel bead dispensing gun for marking pavement which precisely controls the point of beginning and point of ending of the bead discharge commensurate with the stripes being painted upon highway.

A further paramount object of the present invention is the provision of a novel bead dispensing gun for marking pavement which accurately controls by adjustment the rate of bead discharge therefrom and by suspending beads in a suitable liquid which is caused by wetting said bead to adhere firmly to the painted line.

A further and no less important object of the present invention is the provision of a novel bead dispensing gun comprising a bead width control chute which defines a discharge pattern for the beads having a width precisely the same as the width of the stripe being painted on the pavement.

These and other objects and features of the present invention will be apparent from the following detailed description, taken with reference to the accompanying drawings.

DETAILED DESCRIPTION OF ILLUSTRATED EMBODIMENT

Figure 1:
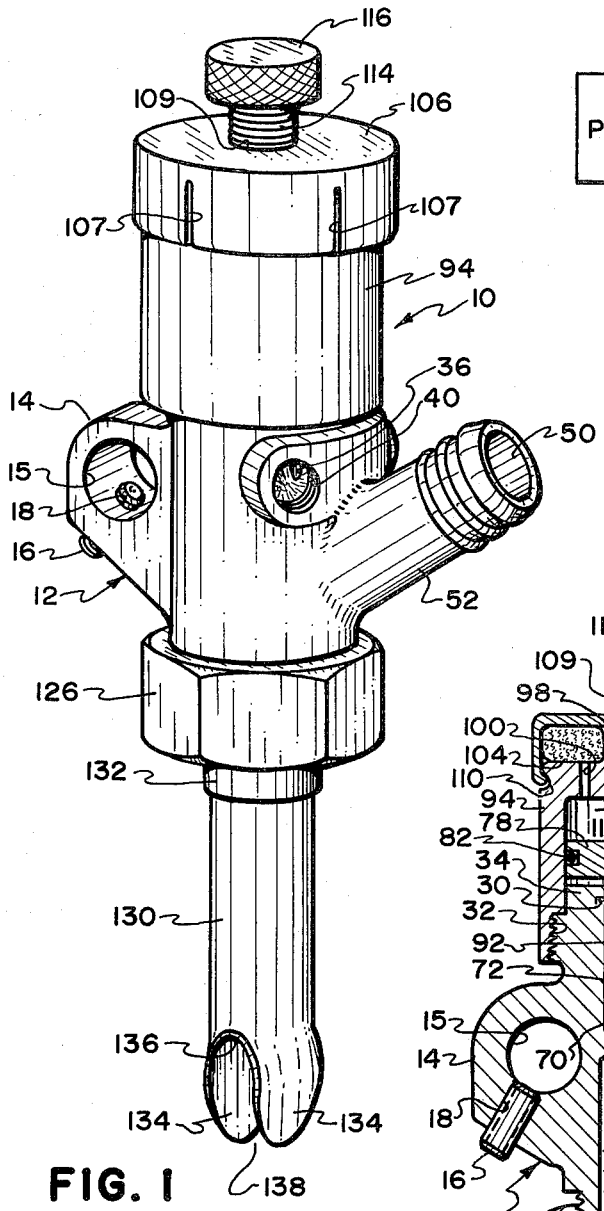
FIG. 1 is a perspective representation of a presently preferred embodiment of the present invention.

Reference is now made to the drawings wherein like numerals are used to designate like parts throughout. The bead dispensing gun, generally designated 10, comprises an external casing or body 12, which includes an anchor 14 comprising a circular eye or aperture 15 through which a mounting rod comprising part of a pavement marking vehicle (not shown) is adapted to be placed so that the gun 10 may be located and thereafter releasably retained along said rod in any desired position by merely tightening of the set screw 16 against the rod, the set screw being threadedly situated in an aperture 18 through the anchor 14.

The body or housing 12 forms part of a cylinder of the gun 10 and comprises a lower end 20 containing external threads 22, as well as an internal stepped bore comprising an enlarged downwardly directed bore segment 24, a reduced diameter central bore segment 26 and a somewhat enlarged upper bore segment 28. The interior of the bore segment 28 defines an annular groove 30 near the top end 34 thereof, while the exterior of the housing adjacent the bore portion 28 comprises external threads 32 at upper end 34. Th upper end 34 also comprises a vertical passageway 36 spanning between an opening at the upper surface 38 and an exteriorly exposed threaded bore 40. The threaded bore 40 is adapted to receive a fitting to permit air pressure from a source 42 to pass across a pressure regulator 44 along a conduit 46, across a solenoid operated valve 48, through the bore 40 and the passageway 36 and into the cylinder at the top surface 38 of the housing or body 12. Typically, 50 psig is adequate pressure. The solenoid operated valve 48 should be located near the gun 10 to avoid any appreciable delay in the opening of the gun.

When the gun 10 is off, the diametrally enlarged bore portion 24 of the body 12 comprises a storage chamber for reflective beads 50, the beads being communicated to said chamber at 24 through a side port 52 and a bead dispensing hose 54, allowing beads from a source 56 (under a controlled amount of air pressure from air source 58 through regulator 60, e.g. 20 psig) to flow to the chamber at 24 across a solenoid operated valve 62 in a manner and under such controls as are hereinafter more fully described. The interior passageway provided by the hose 54, and any fittings or connectors, should be smooth to insure an adequate supply of beads to the nozzle. Ordinarily a limited amount of the air pressure exerted upon the beads will "leak" across the conical end 86 of stem 84 and the interface between valve seat surface 122 and the surface which defines aperture 124, causing beads in chamber 24, port 52 and hose 54 to be aerated and agitated. The flow of beads within the dispensing network can be insured and clogging avoided if liquid is used at reservoir 56 and the liquid is displaced with the bead through the gun under force of air pressure from source 58.

Figure 2:
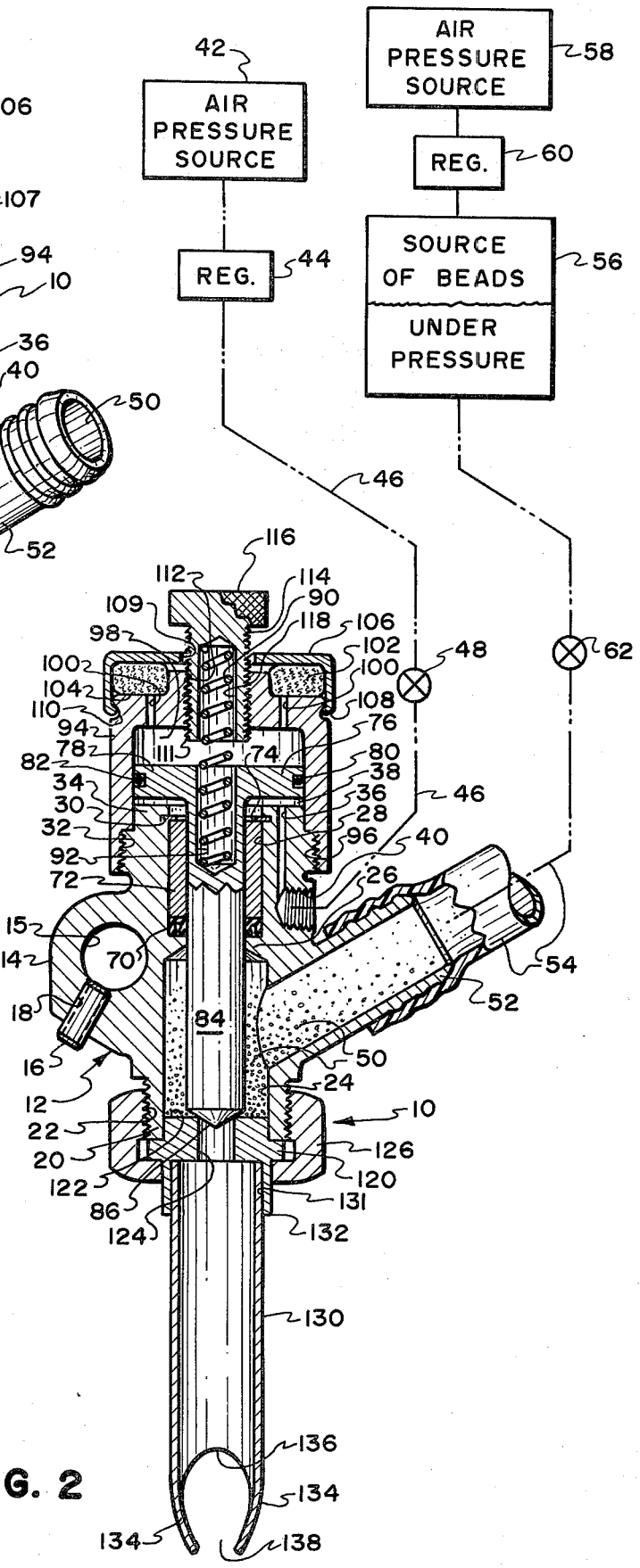
FIG. 2 is a vertical cross section of the bead dispensing gun of FIG. 1 showing the pneumatics associated therewith, the gun being in its closed position.
Figure 3:
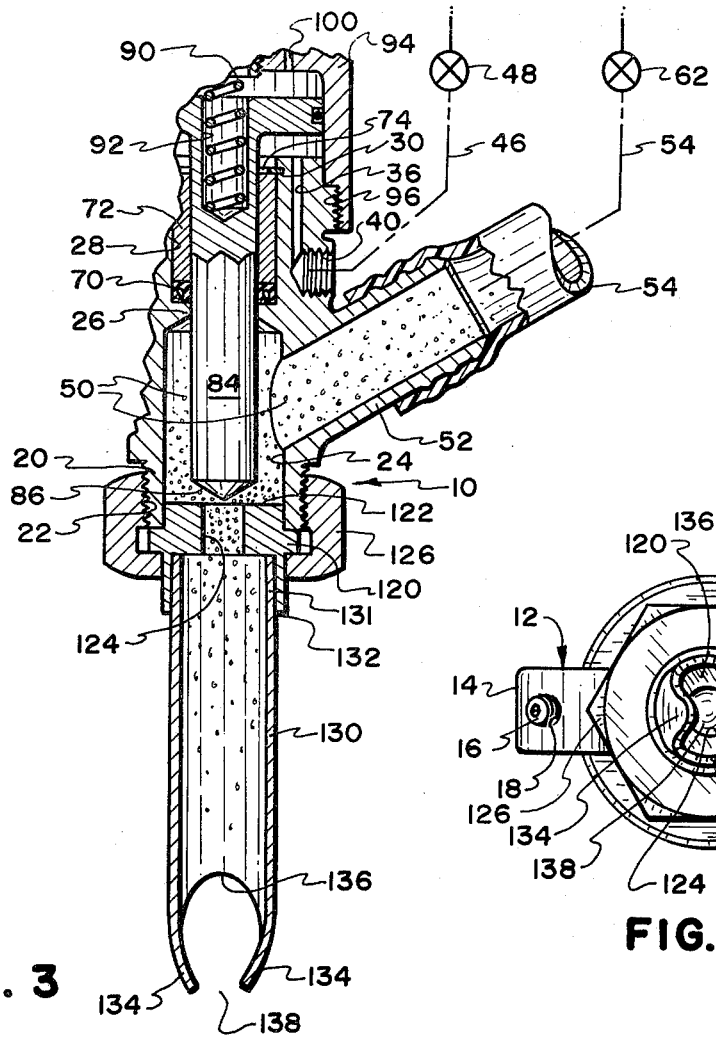
FIG. 3 is a fragmentary cross-sectional view of the bead dispensing gun of FIG. 1 similar to the cross-sectional view of FIG. 2 showing the gun in its open position.
Figure 4:
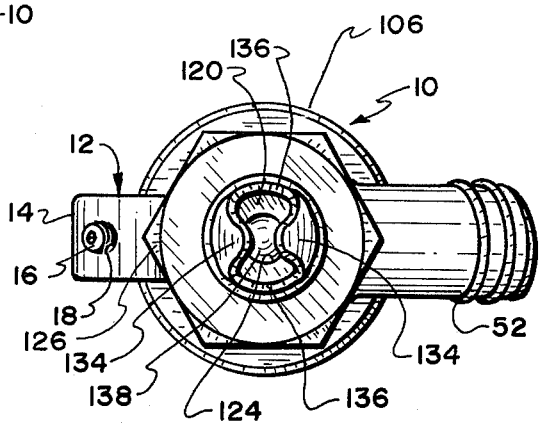
FIG. 4 is a bottom view of the bead dispensing gun of FIG. 1.

An annular fluid seal 70 is snugly placed within the bore portion 28 of the housing 12 at the lower part thereof contiguous with the reduced diameter bore portion 26 and a bearing sleeve 72, of elongated annular configuration, is concentrically placed within said bore portion 28 immediately above the seal 70 as illustrated in FIG. 2, the seal 70 and sleeve 72 being secured in said illustrated position by a snap ring 74.

A piston 76, in the shape of a Tee comprising a disc-shaped head 78 having an annular groove 80 in the periphery thereof in which an O-ring 82 is placed, reciprocates in the mentioned cylinder. The disc 78 of the piston 76 is integral with a stem 84, the stem slidably extending downwardly through the sleeve 72, across the reduced diameter or portion 26 and centrally along the entire length of the bead chamber at 24. The stem 84 terminates in a conical lower end 86 for a purpose hereinafter more fully explained. In short, the piston 76 is caused to reciprocate up and down within the housing or body 12 in a fashion and for purposes hereinafter more fully explained, the sleeve 76 functioning as a bearing accommodating said reciprocation and the seal 70 preventing fluid pressure delivered to the underside of the piston disc 78 within the cylinder from reaching the bead chamber at 24.

The piston 76 is placed in its closed position, illustrated in FIG. 2, in the absence of fluid pressure on the underside of the piston disc 78 by the force of a return spring 90, the lower end of which fits within and abuts the base of a blind bore 92, the blind bore commencing at the upper surface of the disc 78 and extending a distance into the stem 84.

An inverted cup-shaped cap 94 is connected at interior threads 96 to the threads 32 at the upper portion 34 of the housing 12 and creates within its interior a piston chamber 98 in which the piston 96 is reciprocated, the O-ring 82 being in frictional engagement with the interior wall surface of the cap 94. The top of the cap 94 comprises a plurality of vertical apertures 100 through which air is permitted to pass, in each case being filtered by a filter 102, to accommodate the piston reciprocation. The filter 102 is annular in its configuration, fitting within an upper notch 104 in the cap 94 and being held in the illustrated position by a cover 106 held in position by inwardly directed flanges 108 fitted within an exterior groove 110 in the cap 94. The cover 106 is exposed inside and out to atmospheric pressure by vertical slots 107. The cap 94 has a threaded bore 112 centrally within the top thereof, which receives the threads 114 of the cap screw 116, the cap screw 116 having a downwardly extending blind bore 118 within the threaded shank thereof which receives in a butting relation the upper end of the spring 90 thereby holding the piston 76 in its closed position in the absence of air pressure on the underside of the piston disc 78. The cover 106 has a central aperture 109 in the top thereof through which the thumb screw 116 loosely passes.

By adjusting the location of the thumb screw 116 in the threads 118 of the cap 94, the amount of spring force exerted upon the piston 76 may be varied as well as the travel distance between the top surface of the piston disc 78 and the bottom edge 111 of the thumb screw 116 (which will control the distance the stem 84 (and the remainder of the piston) is permitted to elevate within the bead chamber 24. Naturally, the pressure magnitude of the air permitted to pass from the source 42 to the underside of the piston disc 78 will likewise have a controlling influence upon the amount of upward vertical displacement of the piston 76, when fluid pressure is so applied.

The bore portion 24 is substantially closed by a valve seat 120. The valve seat comprises an upper surface 122 and a relatively small discharge port 124, which is aligned with but of substantially smaller diameter than the stem 84 of the piston 76. The location of the valve seat 120 causes the conical end 86 of the stem 84 to seat upon the annular interface between the walls forming the aperture 124 and the upper surface 122 of the seat 120.

The seat 120 is held in the illustrated position by a nut 126 which is internally threaded so as to engage the threads 22 at the lower end 20 of the body 12.

A bead distribution chute 130 is welded or otherwise suitably secured at its upper end 131 to the seat 120 at a downwardly extending annular flange 132, the chute 130 comprising a hollow tube, the diameter of which is substantially greater than the opening or port 124 of the seat 120. The lower end of the bead distribution chute 130 comprises a pair of distributor fingers 134 located opposite each other and each separated from the other by a pair of arched openings 136 by which the "fan" or width of the bead discharged is controlled. Preferably the fingers 134 downwardly converge one toward another to define an opening 138 between the fingers substantially less than the diameter of the remainder of the chute 130. It is normally preferred that the fingers 134 be set manually for each utilization to which the gun 10 is put. This may be done by an initial trial and error process involving the use of a pair of pliers or the like to appropriately bend the fingers 34 into any desired configuration and therafter testing the width of bead discharge. By appropriately locating the fingers 34 one in respect to the other, the width or "fan" of bead discharge is precisely defined so that beads fall almost exclusively upon a stripe being painted on pavement.

It should be appreciated that ordinarily the use of a bead dispensing gun of the type described in this specification will be in conjuction with one or more other bead dispensing guns as well as several paint dispensing guns so that, preferably, in a single pass several layers of paint and several layers of beads may be superimposed upon each other to appropriately mark the lanes of pavement. Other uses may also be made of the present invention.

Figure 5:
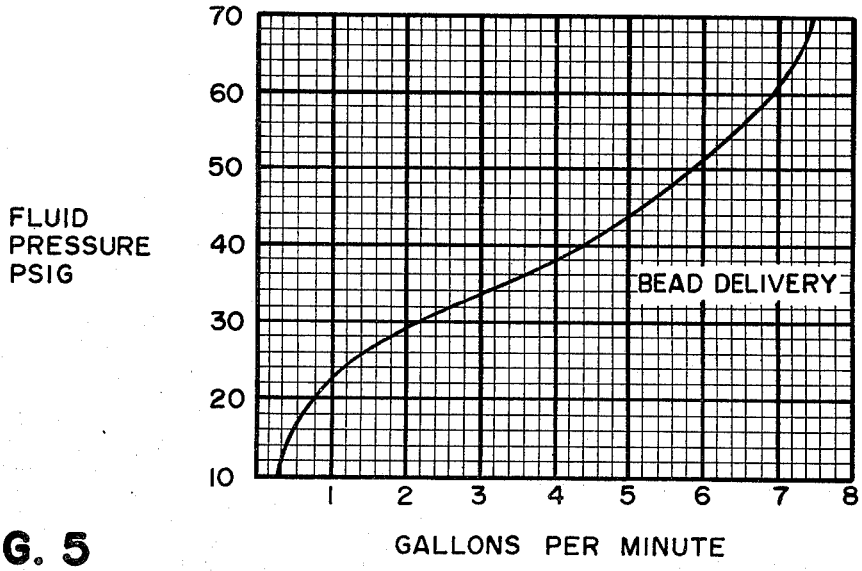
FIG. 5 is a graph showing the optimum bead delivery characteristics of the bead discharge gun of FIG. 1 in respect to the amount of fluid pressure exerted upon the beads in the reservoir.

Using the present invention, it has been found that, in reference to FIG. 5, for example, use of 20 psig air pressure upon the beads will produce, with appropriate discharge setting, a rate of discharge of a little over one gallon of beads per minute for maximum piston stroke setting which, because of the improved precision in (*a*) quantity of beads discharged, (*b*) point of beginning and ending discharge and (*c*) width of discharge using the present invention, results in a substantial savings in beads over the prior art. As mentioned earlier, the rate of bead discharge is controlled by either adjusting the thumb screw 116 or controlling the amount of air pressure delivered from source 42 through passageway 36 to the underside of the piston disc 78 or both. Stated in another way, the present system may be operated using as little as four pounds of beads per gallon of paint whereas prior systems have required on the order of seven pounds of beads per gallon of paint. While the precise amount of beads used in any particular application will change depending upon conditions which vary, for any given application the present invention will result in the use of a lesser quantity of beads.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patents is:

1. A bead dispensing gun adapted to be mounted upon a vehicle and used in marking pavement comprising:

piston means against which fluid pressure is imposed to selectively displace the piston means;

cylinder means within which the piston is caused to reciprocate;

bead accumulation chamber means to which beads are communicated under fluid pressure from a bead source;

valve means associated with the piston means for opening and closing the bead accumulation chamber means to selectively downwardly dispense or accumulate beads, respectively;

hollow dispensing chute means the influent of which is below the bead effluent of the valve means, the hollow of the chute means having a uniform diameter throughout the length thereof, exclusive of the effluent end thereof and being of substantially greater cross-sectional area than that of the valve means effluent, and the effluent end of the chute means being without venturi configuration comprising opposed fingers defining two opposed U-shaped slots, each finger being downwardly convergently tapered to a tip and the two fingers between said U-shaped slot downwardly converging one toward the other whereby the fan of bead discharge is determined.

2. A bead dispensing gun according to claim 1 wherein the exterior of said gun comprises means for releasably mounting the gun to a vehicle.

3. A bead dispensing system adapted to be mounted upon a vehicle and used in marking pavement comprising:

a first source of fluid under relatively high pressure, means for regulating said pressure and means for selectively communicating said pressure to a bead dispensing gun;

a second source of fluid under relatively low pressure including means for regulating said pressure and for communicating said pressure to a supply of beads, and means selectively communicating said beads under relatively low pressure to said bead dispensing gun;

said bead dispensing gun comprising:

piston means;

cylinder means within which the piston means are caused to reciprocate;

passageway means in said gun communicating said relatively high fluid pressure into said cylinder means below said piston means;

bead accumulation chamber means to which beads from said supply are communicated under said relatively low fluid pressure;

valve means associated with the piston means for opening and enclosing the bead chamber means to selectively downwardly dispense or accumulate beads, respectively;

dispensing chute means below the bead effluent of the valve means, the hollow of the chute means having a uniform diameter, exclusive of the effluent end thereof substantially greater than that of the valve means effluent and the chute means comprising an effluent bead discharge opening defined by opposed downwardly converging fingers separated by two U-shaped slots therebetween, the fingers also converging toward each other adjacent the U-shaped slots whereby the width of the bead discharge is precisely predetermined;

manually adjustable means comprising part of the cylinder means directly above the piston means;

the valve means being urged into the closed position by said bias means interposed between the piston means and the manually adjustable means of the cylinder means, adjustment of the manually adjustable means varying the effective length of the bias means and correspondingly altering the force of said bias means against the piston means tending to hold the valve means closed;

selective communication of the relatively high fluid pressure to the underside of the piston means causing the piston means to elevate and the valve means to open counter to the force of said bias means a distance directly corresponding to the force exerted by said bias means and the pressure introduced at the underside of the piston means;

the relatively low fluid pressure aerating and agitating said beads to accommodate uniform discharge when the valve means are open.

* * * * *